US010722018B2

(12) United States Patent
Kelly

(10) Patent No.: US 10,722,018 B2
(45) Date of Patent: Jul. 28, 2020

(54) SAFETY RAZOR CLEANING DEVICE

(71) Applicant: John Alphonsus Kelly, Selkirk (CA)

(72) Inventor: John Alphonsus Kelly, Selkirk (CA)

( * ) Notice: Subject to any disclaimer, the term of this patent is extended or adjusted under 35 U.S.C. 154(b) by 29 days.

(21) Appl. No.: 16/050,358

(22) Filed: Jul. 31, 2018

(65) Prior Publication Data

US 2020/0037726 A1 Feb. 6, 2020

(51) Int. Cl.

| | |
|---|---|
| ***A46B 9/02*** | (2006.01) |
| ***A46B 9/06*** | (2006.01) |
| ***A45D 27/46*** | (2006.01) |
| *B26B 21/40* | (2006.01) |

(52) U.S. Cl.

CPC ..... *A45D 27/46* (2013.01); *A46B 9/025* (2013.01); *A46B 9/06* (2013.01); *A46B 2200/30* (2013.01); *B26B 21/40* (2013.01)

(58) Field of Classification Search

CPC ..... A45D 27/46; A46B 9/025; A46B 9/06
USPC ..... 15/106, 160, DIG. 6
See application file for complete search history.

(56) References Cited

U.S. PATENT DOCUMENTS

| | | | | |
|---|---|---|---|---|
| 3,047,898 | A * | 8/1962 | Levite | A46B 15/00 15/207.2 |
| 4,480,387 | A | 11/1984 | d'Alayer de Costemore d'Are | |
| 4,937,940 | A | 7/1990 | Mason | |
| 5,220,702 | A * | 6/1993 | Howell | A46B 9/06 15/159.1 |
| 5,230,117 | A * | 7/1993 | Johnson | A45F 5/004 15/106 |
| 5,819,355 | A * | 10/1998 | Wu | A46B 15/0055 15/106 |
| 6,112,357 | A * | 9/2000 | Halloran | A46B 17/02 15/106 |
| 8,402,590 | B1 * | 3/2013 | Larson | A46B 9/025 15/160 |
| 9,038,230 | B2 | 5/2015 | O'Neill | |
| 2011/0138557 | A1 * | 6/2011 | Herrmann | A43B 3/163 15/160 |
| 2016/0157594 | A1 * | 6/2016 | Jones | A46B 5/04 15/160 |

FOREIGN PATENT DOCUMENTS

| | | |
|---|---|---|
| WO | WO9000249 | 1/1990 |
| WO | WO2005104922 | 11/2005 |
| WO | WO2012121806 | 9/2012 |

* cited by examiner

*Primary Examiner* — Randall E Chin

(57) ABSTRACT

A safety razor cleaning device includes a handle. A plurality of first bristles and a plurality of second bristles are coupled to and extend transversely from a first end of the handle so that the handle, the plurality of first bristles, and the plurality of second bristles are substantially Y-shaped when viewed from a side of the handle. Each first bristle is flexible and each second bristle is substantially rigid so that the plurality of first bristles is soft and the plurality of second bristles is coarse. The handle is configured to be grasped in a hand, positioning a user to insert the second bristles into slots on a back side of a razor assembly to dislodge debris positioned between razors of the razor assembly. The user also is positioned to brush the first bristles across a front of the razor assembly to clear residual debris from the razors.

9 Claims, 5 Drawing Sheets

SAFETY RAZOR CLEANING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to cleaning devices and more particularly pertains to a new cleaning device for cleaning debris from a razor.

BRIEF SUMMARY OF THE INVENTION

An embodiment of the disclosure meets the needs presented above by generally comprising a handle. A plurality of first bristles and a plurality of second bristles are coupled to and extend transversely from a first end of the handle so that the handle, the plurality of first bristles, and the plurality of second bristles are substantially Y-shaped when viewed from a side of the handle. Each first bristle is flexible and each second bristle is substantially rigid so that the plurality of first bristles is soft and the plurality of second bristles is coarse. The handle is configured to be grasped in a hand, positioning a user to insert the second bristles into slots on a back side of a razor assembly to dislodge debris positioned between razors of the razor assembly. The user also is positioned to brush the first bristles across a front of the razor assembly to clear residual debris from the razors.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
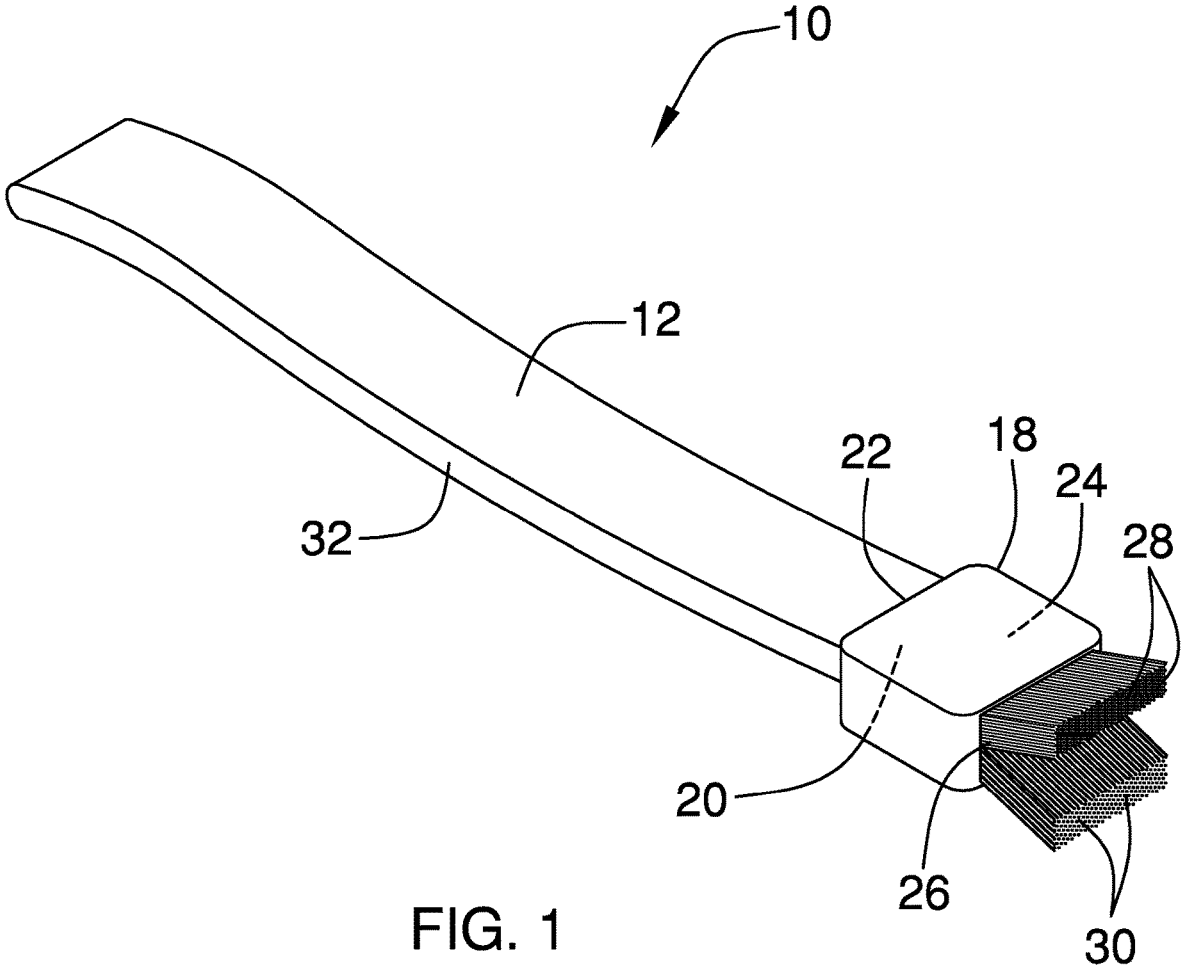
FIG. 1 is an isometric perspective view of a safety razor cleaning device according to an embodiment of the disclosure.

With reference now to the drawings, and in particular to FIGS. 1 through 7 thereof, a new cleaning device embodying the principles and concepts of an embodiment of the disclosure and generally designated by the reference numeral 10 will be described.

Figure 5:
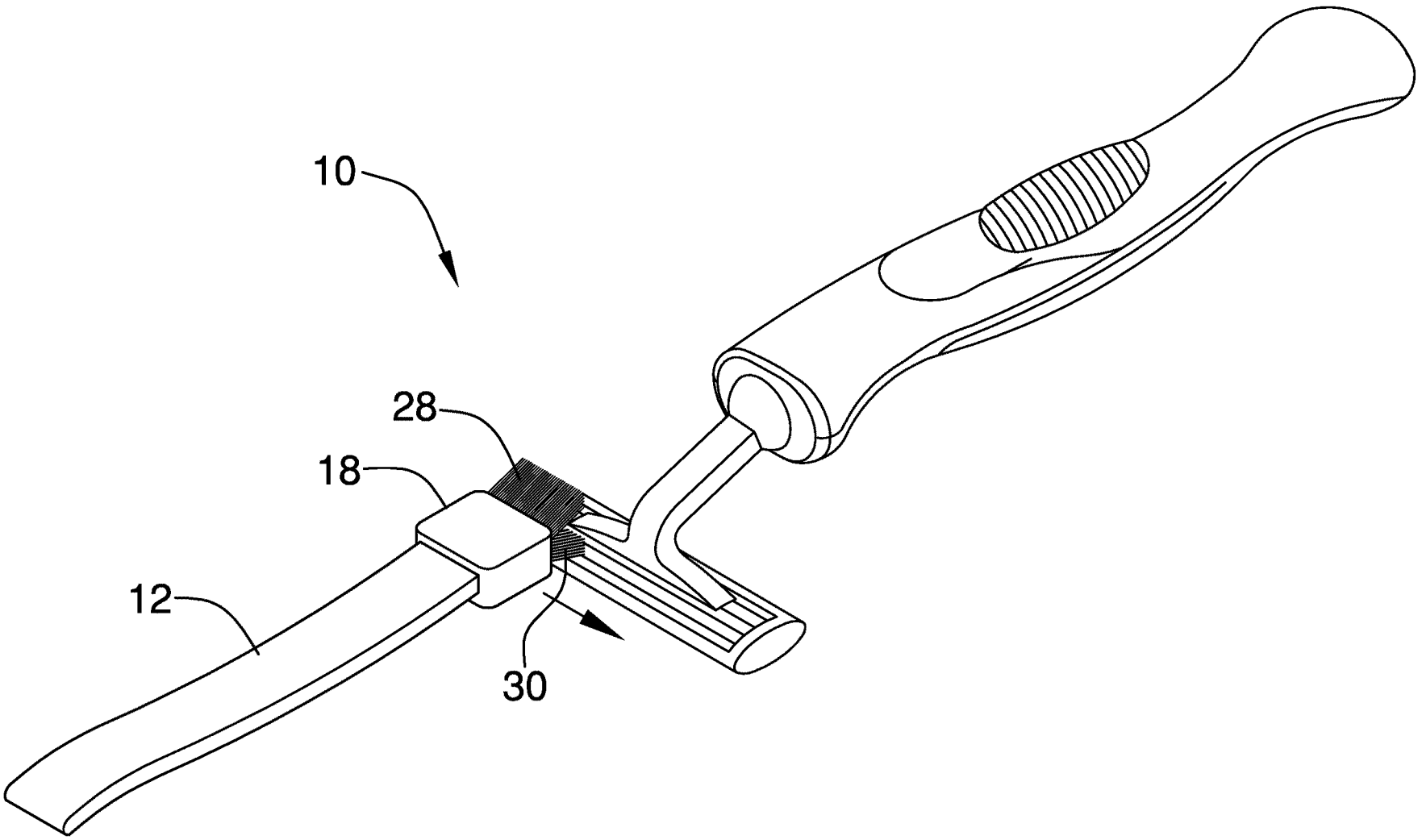
FIG. 5 is an in-use view of an embodiment of the disclosure.
Figure 6:
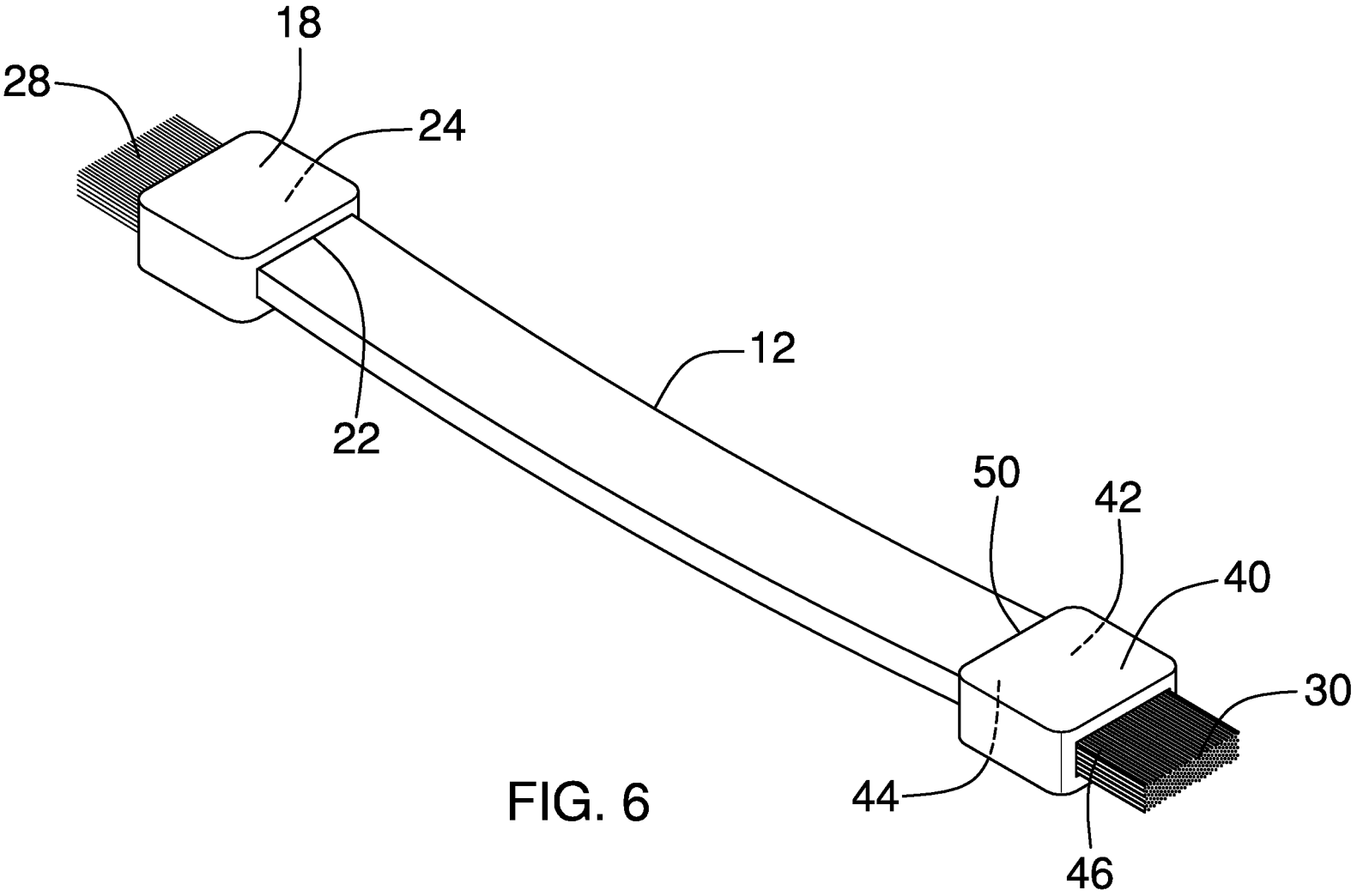
FIG. 6 is an isometric perspective view of an embodiment of the disclosure.
Figure 7:
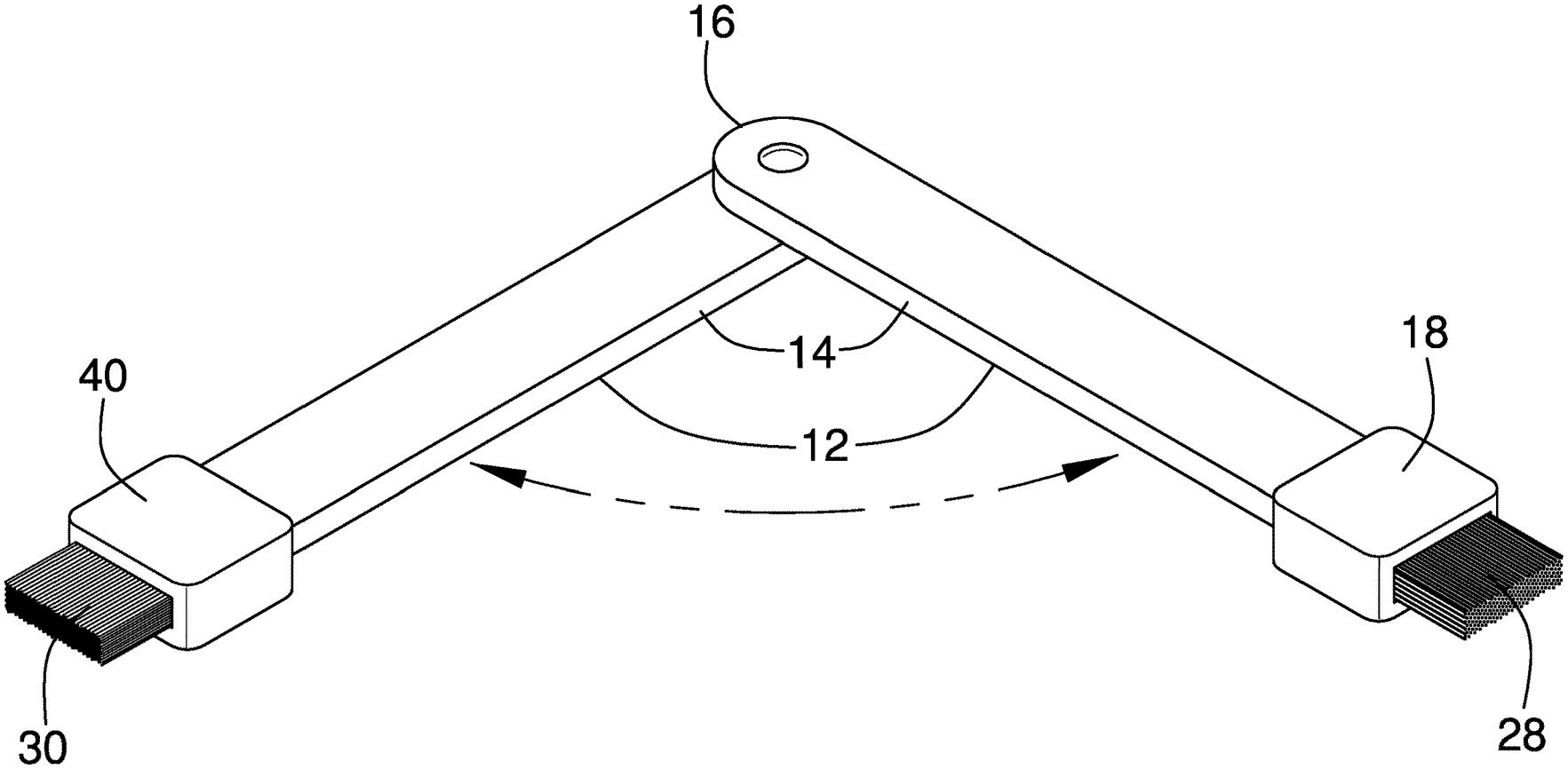
FIG. 7 is an isometric perspective view of an embodiment of the disclosure.

As best illustrated in FIGS. 1 through 7, the safety razor cleaning device 10 generally comprises a handle 12. The handle 12 is substantially rectangularly shaped when viewed longitudinally. In one embodiment, as shown in FIG. 7, the handle 12 comprises a pair of sections 14. Each section 14 has an endpoint 16. The sections 14 are pivotally coupled proximate to the endpoints 16 so that the pair of sections 14 is selectively positionable in a stowed configuration wherein the sections 14 are substantially overlaid.

A first housing 18 is coupled by a first face 20 to a first end 22 of the handle 12. The first housing 18 defines an interior space 24. The first housing 18 has a second face 26 that is open. The first housing 18 is rectangularly box shaped. The first face 20 of the first housing 18 is circumferentially larger than the handle 12.

A plurality of first bristles 28 is coupled to and extends transversely from the first end 22 of the handle 12. Each first bristle 28 is flexible so that the plurality of first bristles 28 is soft. A plurality of second bristles 30 is coupled to and extends transversely from the first end 22 of the handle 12 so that the handle 12, the plurality of first bristles 28, and the plurality of second bristles 30 are substantially Y-shaped when viewed from a side 32 of the handle 12. Each second bristle 30 is substantially rigid so that the plurality of second bristles 30 is coarse.

The handle 12 is configured to be grasped in a hand of a user, positioning the user to insert the plurality of second bristles 30 into slots on a back side of a razor assembly, as shown in FIG. 5, to dislodge debris, such as hair and shaving aids, that is positioned between razors of the razor assembly. The user also is positioned to brush the plurality of first bristles 28 across a front of the razor assembly to clear residual debris from the razors.

Figure 2:
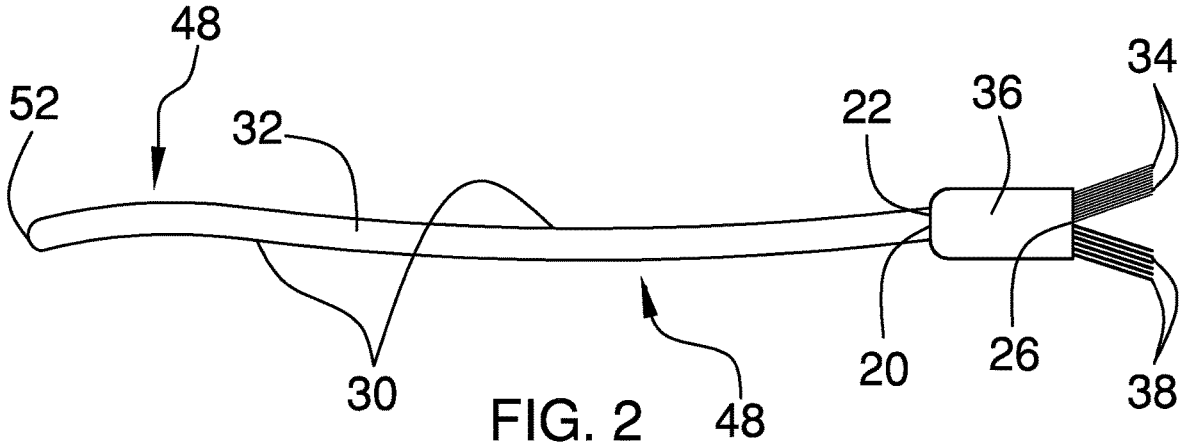
FIG. 2 is a side view of an embodiment of the disclosure.
Figure 3:
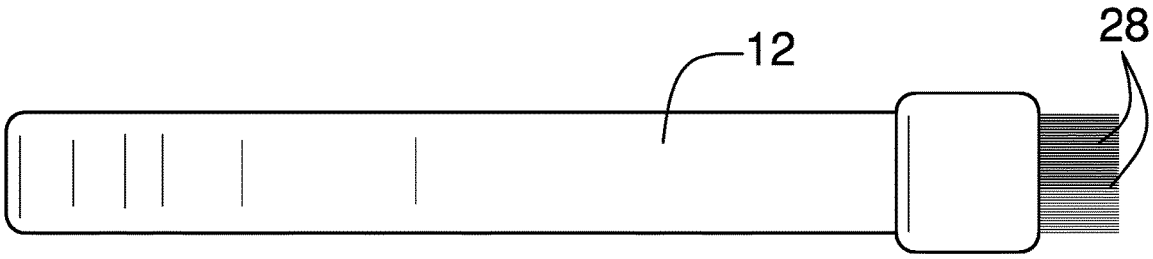
FIG. 3 is a top view of an embodiment of the disclosure.
Figure 4:
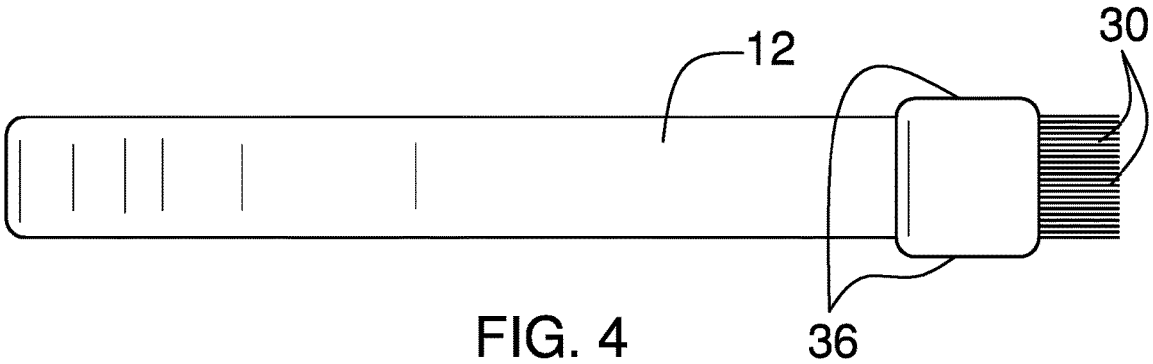
FIG. 4 is a bottom view of an embodiment of the disclosure.

The first bristles 28 are unflocked so that the debris does not accumulate in the first bristles 28. The first bristles 28 comprise horsehair, or the like. Each first bristle 28 is coupled to the first housing 18 and positioned in the interior space 24. The first bristle 28 extends through the second face 26 of the first housing 18 so that the first bristle 28 is transverse to the second face 26. The plurality of first bristles 28 is positioned in a plurality of first rows 34, as shown in FIG. 2. Each first row 34 extends between opposing sides 36 of the first housing 18.

The second bristles 30 are unflocked so that the debris does not accumulate in the second bristles 30. The second bristles 30 comprise a synthetic polymer. The second bristles 30 comprise at least one of an aliphatic polyamide and a semi-aromatic polyamide. Each second bristle 30 is coupled to the first housing 18 and positioned in the interior space 24. The second bristle 30 extends through the second face 26 of the first housing 18 so that the second bristle 30 is transverse to the second face 26. The plurality of second bristles 30 is positioned in a plurality of second rows 38, as shown in FIG. 2. Each second row 38 extends between the opposing sides 36 of the first housing 18. The second bristles 30 being positioned in second rows 38 facilitates insertion of the plurality of second bristles 30 between the razors of the razor assembly.

A pair of bends 48 is positioned in the handle 12. The bends 48 are arcuate and are opposingly positioned in the handle 12 so that the handle 12 is flattened S-shaped when viewed from the side 32 of the handle 12. The bends 48 are configured to enhance a grip of the hand of the user on the handle 12.

In another embodiment, as shown in FIG. 6, a second housing 40 is coupled by a first surface 44 to a second end 50 of the handle 12. The second housing 40 defines an internal space 42. The second housing 40 has a second surface 46 that is open. The second housing 40 is rectangularly box shaped. The first surface 44 of the second housing 40 is circumferentially larger than the handle 12.

In this embodiment, each first bristle 28 is coupled to the first housing 18 and is positioned in the interior space 24. The first bristle 28 extends through the second face 26 of the first housing 18 so that the first bristle 28 extends perpendicularly to the second face 26. Each second bristle 30 is coupled to the second housing 40 and is positioned in the internal space 42. The second bristle 30 extends through the second surface 46 of the second housing 40 so that the second bristle 30 is transverse to the second surface 46.

In use, the handle 12 is grasped in the hand of the user. The plurality of second bristles 30 is inserted into the slots on the back side of the razor assembly to dislodge the debris that is positioned between the razors of the razor assembly. The user then uses the plurality of first bristles 28 to clear the residual debris from the front of the razors of the razor assembly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A safety razor cleaning device comprising:

a handle;

a plurality of first bristles coupled to and extending transversely from a first end of the handle, each first bristle being flexible such that the plurality of first bristles is soft;

a plurality of second bristles coupled to and extending transversely from the first end of the handle such that the handle, the plurality of first bristles, and the plurality of second bristles are substantially Y-shaped when viewed from a side of the handle, each second bristle being substantially rigid such that the plurality of second bristles is coarse wherein the handle is configured for grasping in a hand of a user positioning the user for inserting the plurality of second bristles into slots on a back side of a razor assembly for dislodging debris positioned between razors of the razor assembly and positioning the user for brushing the plurality of first bristles across a front of the razor assembly for clearing residual debris from the razors;

a first housing coupled by a first face to the first end of the handle, the first housing defining an interior space, the first housing having a second face, the second face being open, the first housing being rectangularly box shaped;

each first bristle being coupled to the first housing and positioned in the interior space, the first bristle extending through the second face of the first housing such that the first bristle is transverse to the second face; and each second bristle being coupled to the first housing and positioned in the interior space, the second bristle extending through the second face of the first housing such that the second bristle is transverse to the second face.

2. The device of claim 1, further including the handle being substantially rectangularly shaped when viewed longitudinally.

3. The device of claim 2, further including a pair of bends positioned in the handle, the bends being arcuate, the bends being opposingly positioned in the handle such that the handle is flattened S-shaped when viewed from the side of the handle wherein the bends are configured for enhancing a grip of the hand of the user.

4. The device of claim 1, further including the first bristles and the second bristles being unflocked.

5. The device of claim 1, further comprising:

the second bristles comprising a synthetic polymer; and the first bristles comprising horsehair.

6. The device of claim 5, further including the second bristles comprising at least one of an aliphatic polyamide and a semi-aromatic polyamide.

7. The device of claim 1, further including the first face of the first housing being circumferentially larger than the handle.

8. The device of claim 1, further comprising:

the plurality of first bristles being positioned in a plurality of first rows, each first row extending between opposing sides of the first housing; and the plurality of second bristles being positioned in a plurality of second rows, each second row extending between the opposing sides of the first housing.

9. A safety razor cleaning device comprising:

a handle, the handle being substantially rectangularly shaped when viewed longitudinally;

a first housing coupled by a first face to a first end of the handle, the first housing defining an interior space, the first housing having a second face, the second face being open, the first housing being rectangularly box shaped, the first face of the first housing being circumferentially larger than the handle;

a plurality of first bristles coupled to and extending transversely from the first end of the handle, each first bristle being flexible such that the plurality of first bristles is soft, the first bristles being unflocked, the first bristles comprising horsehair, each first bristle being coupled to the first housing and positioned in the interior space, the first bristle extending through the second face of the first housing such that the first bristle is transverse to the second face, the plurality of first bristles being positioned in a plurality of first rows, each first row extending between opposing sides of the first housing;

a plurality of second bristles coupled to and extending transversely from the first end of the handle such that the handle, the plurality of first bristles, and the plurality of second bristles are substantially Y-shaped when viewed from a side of the handle, each second bristle being substantially rigid such that the plurality of second bristles is coarse wherein the handle is configured for grasping in a hand of a user positioning the user for inserting the plurality of second bristles into slots on a back side of a razor assembly for dislodging debris positioned between razors of the razor assembly and positioning the user for brushing the plurality of first bristles across a front of the razor assembly for clearing residual debris from the razors, the second bristles being unflocked, the second bristles comprising a synthetic polymer, the second bristles comprising at least one of an aliphatic polyamide and a semi-aromatic polyamide, each second bristle being coupled to the first housing and positioned in the interior space, the second bristle extending through the second face of the first housing such that the second bristle is transverse to the second face, the plurality of second bristles being positioned in a plurality of second rows, each second row extending between the opposing sides of the first housing; and a pair of bends positioned in the handle, the bends being arcuate, the bends being opposingly positioned in the handle such that the handle is flattened S-shaped when viewed from the side of the handle wherein the bends are configured for enhancing a grip of the hand of the user.

* * * * *